US007315139B1

(12) United States Patent
Selvan et al.

(10) Patent No.: US 7,315,139 B1
(45) Date of Patent: Jan. 1, 2008

(54) LIGHT SOURCE HAVING MORE THAN THREE LEDS IN WHICH THE COLOR POINTS ARE MAINTAINED USING A THREE CHANNEL COLOR SENSOR

(75) Inventors: Maniam Selvan, Pulau Penang (MY); Yoke Peng Boay, Gelugor Penang (MY); Hooi Choo Kang, Georgetown Penang (MY)

(73) Assignee: Avago Technologis ECBU IP (Singapore) Pte Ltd, Singapore (SG)

( * ) Notice: Subject to any disclaimer, the term of this patent is extended or adjusted under 35 U.S.C. 154(b) by 0 days.

(21) Appl. No.: 11/565,540

(22) Filed: Nov. 30, 2006

(51) Int. Cl.
*G05F 1/00* (2006.01)

(52) U.S. Cl. ..... 315/291; 315/312; 315/169.1; 315/294; 315/149; 250/205; 257/82; 257/89; 362/276

(58) Field of Classification Search ..... 315/169.1, 315/169.3, 291, 294, 307, 360, 224, 149, 315/158; 257/82, 88, 89; 250/205, 552; 362/276, 800
See application file for complete search history.

(56) References Cited

U.S. PATENT DOCUMENTS

| | | | | |
|---|---|---|---|---|
| 6,630,801 | B2 * | 10/2003 | Schuurmans | 315/307 |
| 7,119,500 | B2 * | 10/2006 | Young | 315/294 |
| 7,140,752 | B2 * | 11/2006 | Ashdown | 362/276 |
| 7,230,222 | B2 * | 6/2007 | Cheng et al. | 250/205 |
| 2005/0133686 | A1 * | 6/2005 | Ng et al. | 250/206.1 |

* cited by examiner

*Primary Examiner*—Haissa Philogene

(57) ABSTRACT

A light source having first, second, and third component light sources that are driven by first, second, and third primary drive circuits is disclosed. Each primary drive circuit provides an average current to a corresponding one of the component light sources. A photodetector and processor generate three intensity signals representing the intensity of light produced by each of the component light sources. A servo loop adjusts the drive circuits so as to maintain the intensity signals at corresponding target values. One of the compound light sources includes first and second LEDs that are driven such that the currents through the LEDs are maintained at a fixed ratio by a secondary drive circuit that is connected to the third primary drive circuit. The magnitude of the currents is determined by the third primary drive circuit.

6 Claims, 3 Drawing Sheets

LIGHT SOURCE HAVING MORE THAN THREE LEDS IN WHICH THE COLOR POINTS ARE MAINTAINED USING A THREE CHANNEL COLOR SENSOR

BACKGROUND OF THE INVENTION

Consider a light source that is constructed from three component light sources in which each component light source emits light in a different region of the optical spectrum. The light from this source will be perceived by a human observer to be of a single color that is determined by the intensities of the component light sources and the spectrum of light emitted by each component light source. If the component light sources emit light in sufficiently different regions of the optical spectrum, the perceived color can be varied over a large gamut of colors. Light sources that utilize red, green, and blue (RGB) component light sources are commonly used to generate light in this manner.

The perceived colors that can be generated with such a light source are often represented in a two-dimensional color diagram in which the component light sources define a triangular area that contains the various color points that can be reached by that light source. In general, not all of the possible color points in the color space can be reached with a three-component color light source that utilizes existing light sources such as light emitting diodes (LEDs). To reach color points in part of the remaining area in the color space, a fourth light source is often utilized. The fourth light source expands the available color points to those bounded by a quadrangle that contains the original triangular area.

When the color point is determined by three light sources, there is a unique solution to the problem of adjusting the intensities of the three light sources to provide a particular color point within the available color space. However, when 4 light sources are used, in general, there is no longer a unique solution to the problem of determining the intensities of the 4 light sources that will provide a particular color point. That is, there are a number of different combinations of light source intensities that will produce the same perceived color. Hence, a different control strategy is required to decide on the combination of intensities to use.

If the output of each of the component light sources maintains a constant as a function of the power applied to that component light source over time, the power levels can be set by an appropriate algorithm and the light source will maintain the desired color. However, if the spectrum from one or more of the component light sources changes over time, the situation becomes more complicated. Light sources that utilize LEDs often fall in this category.

LEDs have a number of advantages over conventional light sources based on incandescent lamps or fluorescent tubes, and hence, there has been considerable interest in color light sources based on LEDs. LEDs have significantly longer lifetimes than both incandescent lamps and fluorescent tubes. In addition, LEDs already have significantly greater efficiency in converting electrical power to light than incandescent light bulbs. In fact, LEDs in some color ranges already have higher conversion efficiencies than fluorescent tubes. Finally, LEDs do not require the high voltages associated with fluorescent tubes. Hence, LEDs are an attractive alternative for such variable color light sources.

Unfortunately, LEDs suffer from aging effects. The light output for a given current through the LED tends to decrease over time. The rate of aging depends on the specific type of LED and can also vary from production lot to production lot. Hence, the component light sources age at different rates. As a result, the perceived color of the light source shifts with time if corrective action is not taken.

To correct for aging problems, LED-based light sources often include a photodetector that monitors the output of the light source in a number of wavelength bands and a feedback system that varies the current through the LEDs as the LEDs age to assure that the output of the light source remains at the same point in the color space as the light source ages. Typically, the light from the LEDs is monitored in three different color bands that approximate the red, blue, and green emission bands of the corresponding LEDs. The photodetector typically consists of 3 photodiodes. Each photodiode is covered by an appropriate bandpass filter that assures that the photodiode output is related to the intensity of light in the corresponding band.

The output of the photodiodes does not exactly correspond to the emission spectra of the LEDs. As a result, the signal from any given photodiode typically represents a weighted sum of the light output of more than one LED. To provide values that correspond to the light output of each LED, the signals from the three photodiodes must be processed mathematically to provide a set of corrected signals in which each corrected signal measures the light output from one of the LEDs. The processing typically involves solving a 3×3 system of linear equations.

Given a perceived color that is to be maintained and knowledge of the emission spectra from each of the LEDs, the average light output that is to be provided through each of the LEDs can be determined. This light output is converted to an average current to be provided to each LED. As an LED ages, the measured light output from that LED decreases. The decrease is measured with the photodetector, and the current to that LED is increased until the measured light output is returned to the desired value. Single chip integrated circuit controllers for performing this servo loop are available. These controllers include the hardware to solve the system of the linear equations discussed above.

When a fourth LED is added to the light source to expand the color gamut of the light source, the control strategy discussed above becomes significantly more complicated. In principle, a similar servo control loop can be utilized for such four LED light sources. However, the analogous control system requires a photodetector that provides four color intensity signals in four different spectral bands. The computational workload imposed by the resultant 4×4 system of linear equations is significantly greater than that imposed by the 3×3 system of equations, which increases the cost of the controller. Furthermore, a different controller chip would need to be developed and produced to implement the servo loop for such 4 LED light sources. Since such light sources have significantly smaller markets, the economies of scale available in the present three LED controllers are not yet available.

Furthermore, there is no unique solution to the control problem. For example, if one of the 4 LEDs ages, one could alter the intensity of the LED in question. Alternatively, the intensities of the other LEDs could be altered to provide the same color point and intensity.

SUMMARY OF THE INVENTION

The present invention includes a light source having first, second, and third component light sources that are driven by first, second, and third primary drive circuits. Each primary drive circuit provides an average current to a corresponding one of the component light sources. The light source also includes a photodetector that generates three measurement signals representing, respectively, an intensity of light generated by the component light sources in three wavelength bands. A processor generates three intensity signals representing the intensity of light produced by each of the first, second, and third component light sources, respectively, from the measurement signals. A servo loop adjusts the drive circuits so as to maintain the intensity signals at corresponding target values. One of the compound light sources includes first and second LEDs and a secondary drive circuit. The secondary drive circuit is connected to the third primary drive circuit and provides first and second drive currents to the first and second LEDs, respectively. The first and second drive currents are in a fixed ratio to one another and have values determined by the average current from the third primary drive circuit.

DETAILED DESCRIPTION OF THE PREFERRED EMBODIMENTS OF THE INVENTION

Figure 1:
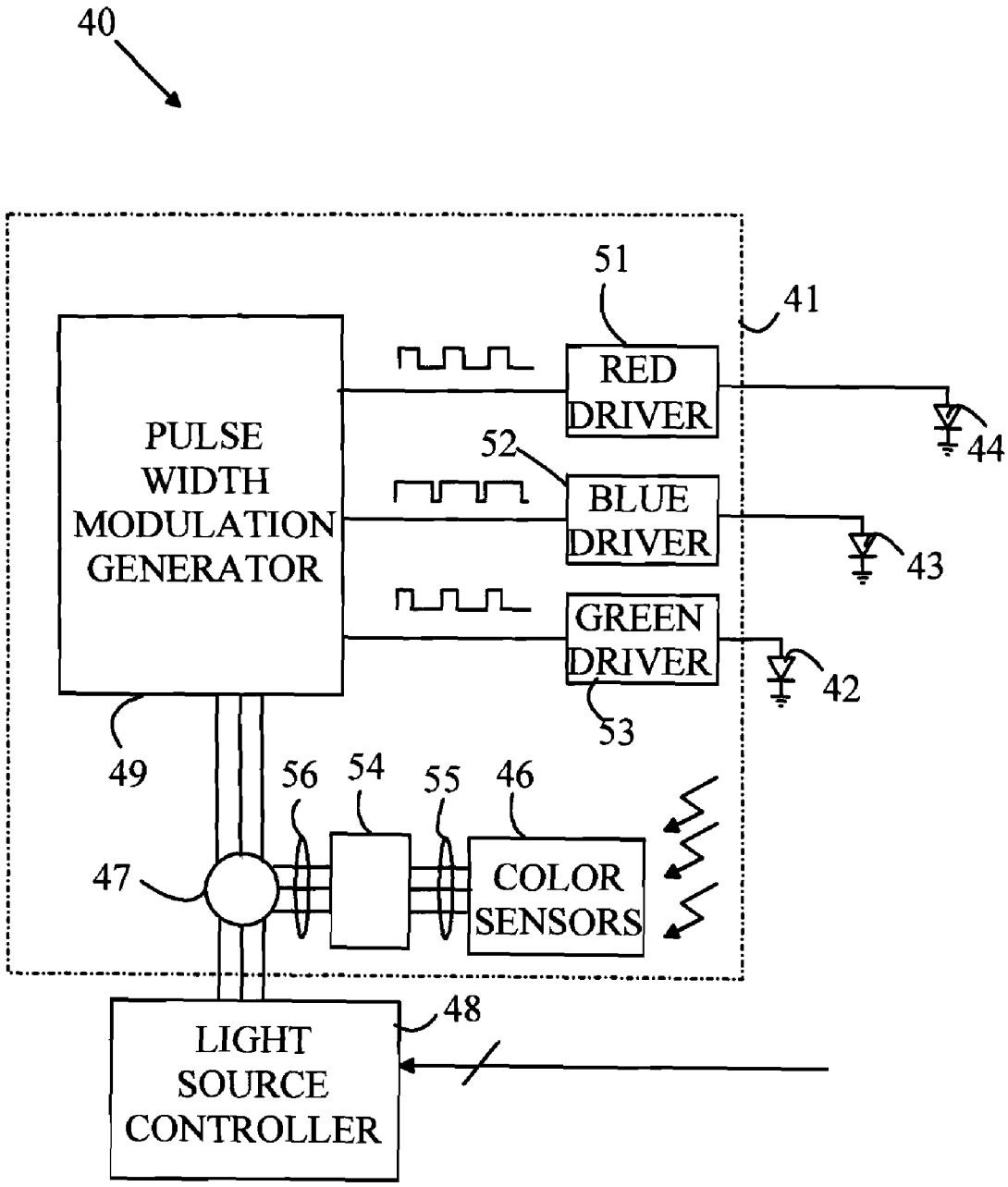
FIGURE 1 (PRIOR ART)
FIG. 1 is a block diagram of a prior art three-color light source.

The manner in which the present invention provides its advantages can be more easily understood with reference to FIG. 1, which is a block diagram of a prior art three-color light source 40. Light source 40 includes three LEDs. The red, blue, and green LEDs shown at 42-44, respectively, are controlled by a color controller 41. Color controller 41 includes a color sensor 46 that measures the light generated by all three LEDs. Color sensor 46 is placed at a location at which the light from the various LEDs has had an opportunity to mix.

Color sensor 46 generates signals indicative of the intensity of light received by color sensor 46 in the optical bands around red, blue, and green. As noted above, color sensor 46 could be constructed from a set of three photodiodes in which each photodiode has a corresponding bandpass filter that limits the light reaching that photodiode to light in one of the optical bands in question. However, many other forms of color sensor are known to the art and could be utilized.

The outputs of color sensor 46 are input to a processor 54 on bus 55. Processor 54 converts the observed photodiode intensities to signals that are proportional to the average intensity of light emitted by each of the LEDs and provides the intensity signals on bus 56. These intensity signals are compared with target values from an external light source controller 48 by comparator 47 and the difference signal is used to control the modulation of the current to the LEDs.

The LEDs are turned on and off at a rate that is too fast for the human eye to perceive. The observer sees only the average light generated by the LEDs. The average current through the LEDs is set by setting the percentage of the time in each cycle that the LEDs are on, rather than by varying the magnitude of a constant current that is passed through the LED. Pulse width modulation generator 49 adjusts the duty factor for each set of LEDs to minimize the error signals. A set of current drivers 51-53 provides the current to each set of LEDs.

As noted above, the bandpass filters of the photodiodes do not exactly match the emission spectrum of the LEDs. In addition, some of the LEDs emit light over a portion of the spectrum that is within the bandpass filter of more than one of the photodiodes. As a consequence, the output of each photodiode is related to the light intensity of more than one LED. If the measured output signal of the $j^{th}$ photodiode is denoted by $P_j$, for j=1, 2, 3, then the intensity of light emitted from the three LEDs can be obtained by solving a 3×3 system of linear equations:

$$P_k = \sum_{j=1}^{3} R_{k,j} I_j$$

for k=1 to 3. Here, $I_k$ is the intensity of light from the $k^{th}$ photodiode. Here, $R_{k,j}$ is the contribution of light from the $k^{th}$ LED in the $j^{th}$ photodetector.

These coefficients can be determined for any particular controller and set of LEDs by powering each LED separately and observing the signal from each of the photodiodes. For example, consider the case in which the first LED is turned on at an intensity that corresponds to an average current through the LED of 1 unit. Then, the values of $R_{k,1}$ can be seen to be equal to the measured photodetector signals, $P_k$, for k=1 to 3, respectively. It should be noted that the choice of current corresponding to 1 unit is arbitrary. All future currents will be proportional to that current.

The coefficients $R_{k,j}$ define a matrix R. Once R is known, its inverse can be calculated and stored in the controller. Hence, the intensity of light from the $I^{th}$ LED can be computed from the measured photodiode signals:

$$I_k = \sum_{j=1}^{3} R_{k,j}^{-1} P_j$$

for k=1 to 3. Here $R^{-1}_{kj}$ are the coefficients of the inverse matrix.

As noted above, when there are three detectors and three photodiodes with appropriately chosen bandpass filters, this inverse matrix can be computed, and hence, the output of the individual LEDs can be uniquely determined.

Figure 2:
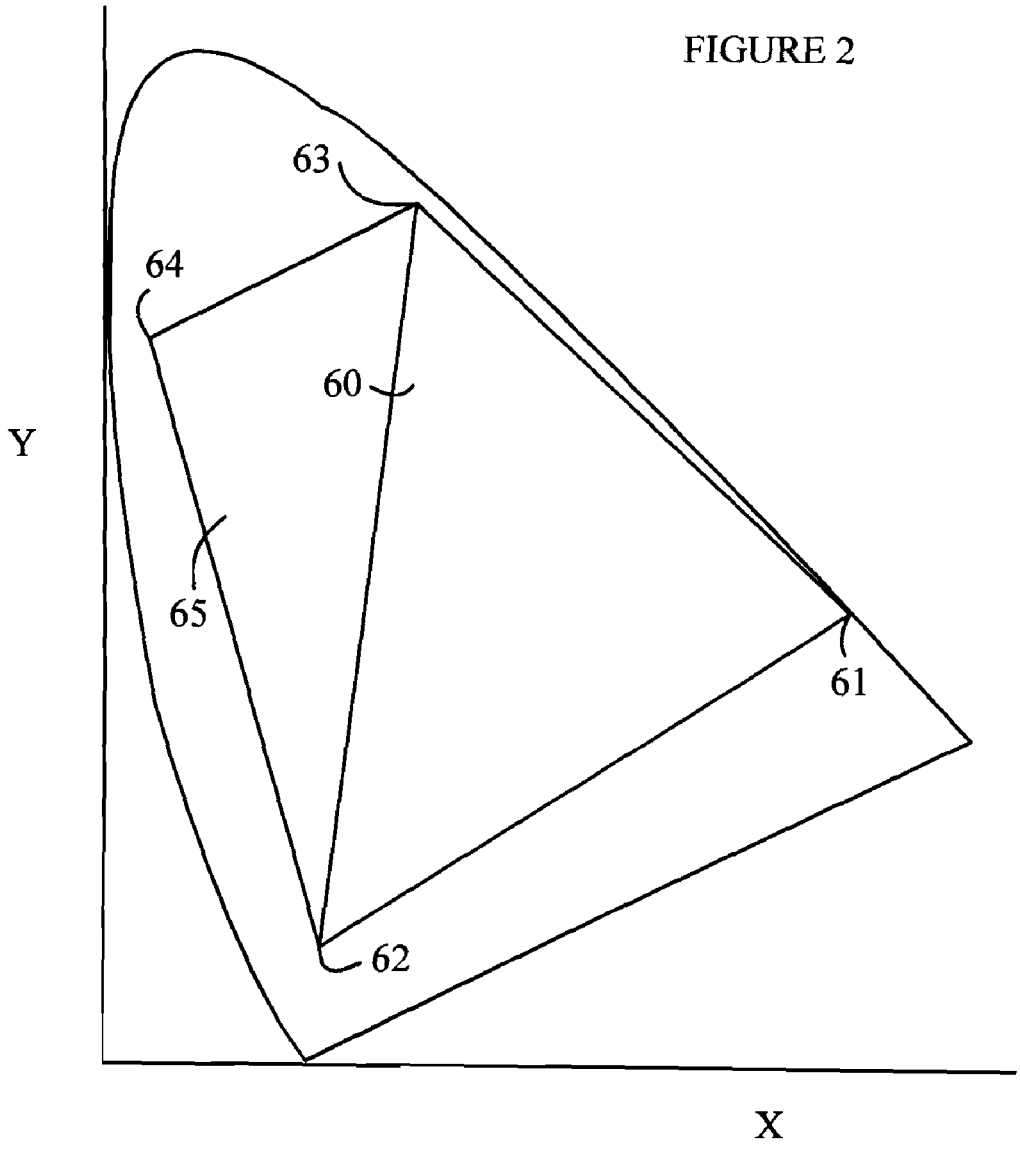
FIG. 2 illustrates the portion of the color space that can be reached by a typical RGB light source.

Refer now to FIG. 2, which illustrates the portion of the color space that can be reached by a typical RGB light source. The area within triangle 60 represents the color points that can be reached by using the three LEDs shown at 61-63. A color point within the triangle is replicated by adjusting the ratios of the intensities of LEDs 61-63. Given any point within the triangle, and a desired intensity, there is a unique set of intensity values for the three light sources that will provide light of that perceived color and intensity.

As can be seen from the figure, there is a considerable area outside of triangle 60 that cannot be reached by the three LEDs. One method for reaching points outside triangle 60 is to include a fourth LED such as LED 64 in the light source to expand the available color points to those shown at 65.

Unfortunately, the addition of the fourth LED requires an alteration in the control strategy for the light source. The three photodiode controller discussed above must be modified by the addition of a fourth photodiode and bandpass filter to allow the intensities of all four LEDs to be monitored so that the servo loop will maintain the LED intensities at the desired values as the LEDs age. In such a system, a processor analogous to processor 54 discussed above converts the 4 intensity values from the photodetector to 4 intensity values representing the intensities of the LEDs. In this case, the processor must solve a 4×4 system of equations to obtain the inverse matrix and the processor must perform 16 multiples and adds instead of the 9 multiples and adds to generate the intensity values used by the servo loop. Hence, the computational workload is significantly greater, which increases the cost. In addition, as noted above, there is a limited market for such control chips, and hence, the cost is increased further, since the design and setup costs must be amortized over a much smaller number of controllers.

The present invention overcomes this problem by driving two of the four LEDs in a manner in which the ratio of the average currents through the two LEDs is set to a constant value. Since the ratio of the two LEDs in question remains constant, there is now a unique solution for the LED intensities computation using only 3 photodiodes, and the existing three-color controller chip can be utilized. In essence, the 4 LED light source is converted to a three LED light source in which one of the "LEDs" has a spectrum that is a weighted sum of the spectra of two LEDs. To simplify the following discussion, this LED will be referred to as a "compound LED".

This strategy is equivalent to replacing the triangle 60 shown in FIG. 2 with a new triangle that has apexes at LEDs 61, 62, and a point located on the line joining LEDs 63 and 64. The position of this point is determined by the ratio of the drive currents. The point is chosen such that the new triangle contains the color points of interest.

Figure 3:
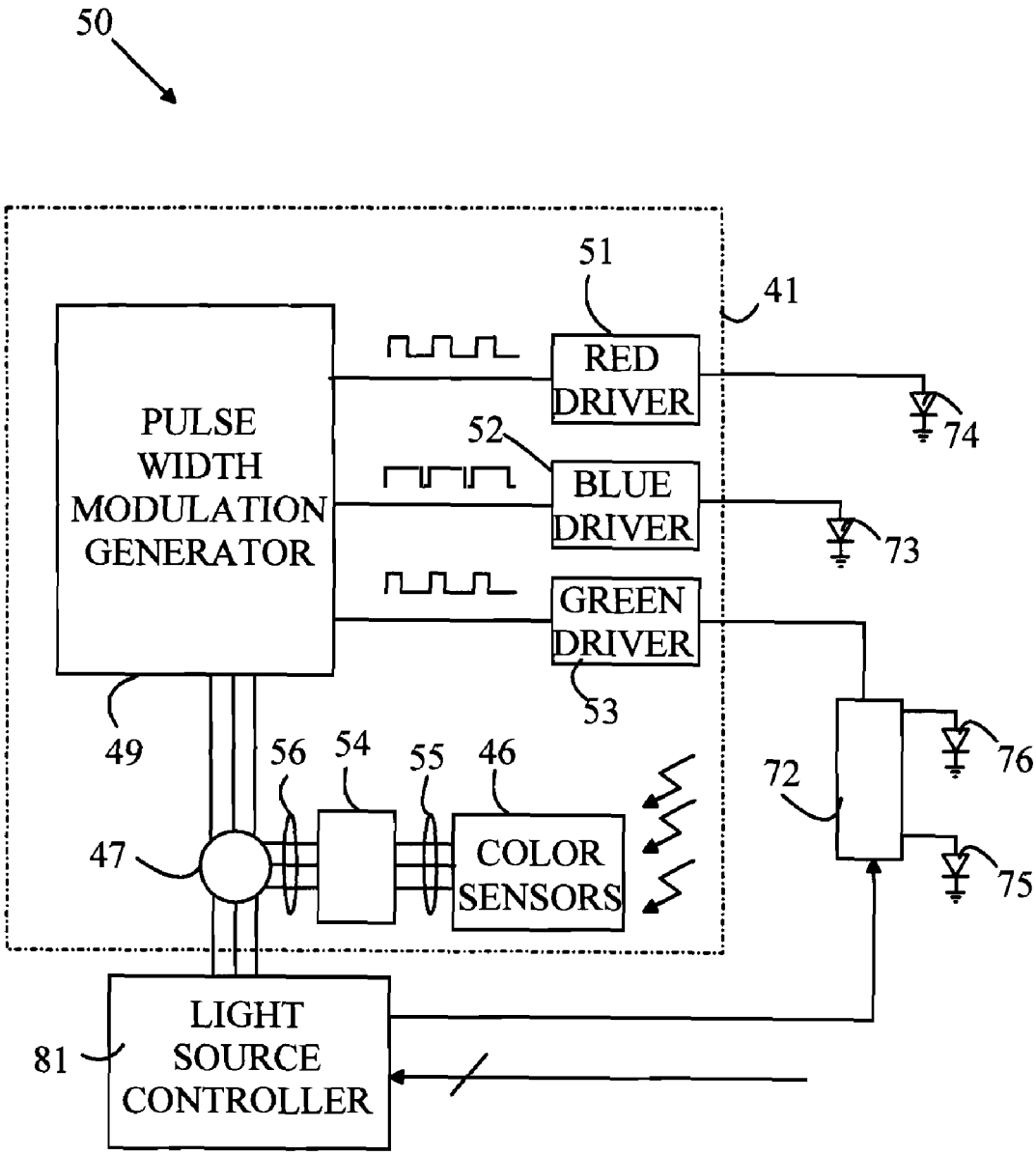
FIG. 3 illustrates a light source according to one embodiment of the present invention.

Refer now to FIG. 3, which illustrates a light source according to one embodiment of the present invention. Light source 50 is similar to light source 40 discussed above in that light source 50 utilizes a conventional three-color controller to control the LEDs. Light source 50 differs from light source 40 in that four LEDs 73-76 having different output spectra are utilized. LEDs 75 and 76 are driven by a secondary driver 72 that maintains the average current ratio at a constant value. In this case, the conventional three-color control chip treats the combination of the LEDs 75 and 76 as a single LED having a spectrum that is the sum of the emissions of those two LEDs. This reduces the control problem to solving a new 3×3 system of equations.

Color controller 41 functions in the same manner as that described with reference to FIG. 1. The coefficients of the calibration matrix are measured in the same manner. In one embodiment, external light source controller 81 receives signals specifying the current ratio to be used by secondary driver 72 and sets that ratio by an appropriate signal to secondary driver 72. Controller 81 then signals color controller 41 to perform a calibration operation to determine the coefficients of the inverse calibration matrix discussed above. Once color controller 41 is calibrated, light source controller 81 communicates the intensity values that are to be maintained for a color point that is specified by signals to controller 81, and the light source functions as if it were a three LED light source with color controller 41 maintaining the outputs of the LEDs at the targeted values.

The control strategy discussed above assumes that the shape of the spectrum emitted by each LED remains constant over time. That is, the LED ages only in that the intensity of light generated by the LED as a function of the current through the LED decreases with age. This aging constraint is inherent both in conventional three LED light sources and in the light source of the present invention. In the case of the present invention, one of the LEDs is the compound LED. This aging constraint must apply to the spectrum of the compound LED. To satisfy this constraint, it is not sufficient that the individual LEDs satisfy the constraint, since the LEDs could still age at different rates, and hence, the shape of the compound spectrum would change over time. Accordingly, the individual LEDs that make up the compound LED are preferably chosen such that they age at substantially the same rate. The degree of similarity in the aging rates depends on the acceptable level of color shift over the lifetime of the light source. In this regard, it should be noted that the light source could be re-calibrated periodically to provide controller 81 with a new mapping of the LED locations in the color space so that controller 81 can properly map a desired color point to the required target intensity values with the aged LEDs.

The above-described embodiments of the present invention utilize one compound LED and two conventional LEDs. However, embodiments in which two or three compound LEDs are utilized could also be constructed. Furthermore, a compound LED could be constructed from more than two conventional LEDs, provided the ratios of the currents in the various LEDs within the compound LED are held constant.

Various modifications to the present invention will become apparent to those skilled in the art from the foregoing description and accompanying drawings. Accordingly, the present invention is to be limited solely by the scope of the following claims.

What is claimed is:

1. A light source comprising:

first, second, and third component light sources;

first, second, and third primary drive circuits, each primary drive circuit providing an average current to a corresponding one of said component light sources;

a photodetector that generates three measurement signals representing, respectively, an intensity of light generated by said component light sources in three wavelength bands;

a processor that generates three intensity signals representing the intensity of light produced by each of said first, second, and third component light sources, respectively, from said measurement signals; and a servo loop that adjusts said drive circuits so as to maintain said intensity signals at corresponding target values, wherein one of said component light sources comprises first and second LEDs and a secondary drive circuit, said secondary drive circuit being connected to said third drive circuit and providing first and second drive currents to said first and second LEDs, respectively, said first and second drive currents being in a fixed ratio to one another and having values determined by said average current from said third primary drive circuit.

2. The light source of claim 1 wherein said first and second component light sources comprise LEDs.

3. The light source of claim 1 further comprising a controller for providing said target values and setting said ratio to said secondary drive circuit.

4. The light source of claim 1 wherein each of said component light sources is driven with an alternating signal having a fixed amplitude and a variable duty factor, and wherein said servo loop varies said duty factor to maintain said intensity signals at said target values.

5. The light source of claim 1 wherein said primary drive circuits, said processor, and said servo loop are contained on a single integrated circuit chip.

6. The light source of claim 5 wherein said integrated circuit chip further comprises said photodetector.

* * * * *

UNITED STATES PATENT AND TRADEMARK OFFICE

CERTIFICATE OF CORRECTION

PATENT NO. : 7,315,139 B1
APPLICATION NO. : 11/565540
DATED : January 1, 2008
INVENTOR(S) : Maniam Selvan et al.

It is certified that error appears in the above-identified patent and that said Letters Patent is hereby corrected as shown below:

Title Page, Column 1, (Assignee), line 1, delete "Technologis" and insert -- Technologies --;

Title Page, Column 1, (Abstract), line 10, delete "compound" and insert -- component --.

Signed and Sealed this

Eighth Day of June, 2010

David J. Kappos

David J. Kappos
*Director of the United States Patent and Trademark Office*